US011204165B2

(12) United States Patent
Bellis

(10) Patent No.: US 11,204,165 B2
(45) Date of Patent: Dec. 21, 2021

(54) BURNER

(71) Applicant: ROLLS-ROYCE plc, London (GB)

(72) Inventor: Mark Je Bellis, Derby (GB)

(73) Assignee: Rolls-Royce plc

( * ) Notice: Subject to any disclaimer, the term of this patent is extended or adjusted under 35 U.S.C. 154(b) by 142 days.

(21) Appl. No.: 16/390,548

(22) Filed: Apr. 22, 2019

(65) Prior Publication Data

US 2019/0353350 A1 Nov. 21, 2019

(30) Foreign Application Priority Data

May 18, 2018 (GB) ..... 1808070

(51) Int. Cl.

| | |
|---|---|
| ***F23R 3/00*** | (2006.01) |
| ***F23R 3/26*** | (2006.01) |
| ***F23C 7/00*** | (2006.01) |
| ***F23R 3/14*** | (2006.01) |

(52) U.S. Cl.

CPC ..... *F23R 3/26* (2013.01); *F23C 7/006* (2013.01); *F23R 3/14* (2013.01)

(58) Field of Classification Search

CPC .... F23C 7/006; F23R 3/16; F23R 3/10; F23R 3/04; F23R 3/14; F23R 3/26; F15D 1/12; F15D 1/06; F15D 1/065

See application file for complete search history.

(56) References Cited

U.S. PATENT DOCUMENTS

| | | | | |
|---|---|---|---|---|
| 3,643,431 | A * | 2/1972 | Jamieson | F15D 1/06 60/738 |
| 4,255,927 | A | 3/1981 | Johnson et al. | |
| 5,394,688 | A | 3/1995 | Amos | |
| 2001/0052229 | A1 | 12/2001 | Tuthill et al. | |
| 2010/0092901 | A1* | 4/2010 | Yoshida | F23R 3/26 431/281 |

(Continued)

FOREIGN PATENT DOCUMENTS

| | | |
|---|---|---|
| CA | 2254978 | 11/1997 |
| EP | 0491325 | 6/1992 |

(Continued)

OTHER PUBLICATIONS

European search report dated May 17, 2019, issued in EP Patent Application No. 19169731.

(Continued)

*Primary Examiner* — Edwin Kang

(74) *Attorney, Agent, or Firm* — Barnes & Thornburg LLP

(57) ABSTRACT

There is provided a burner for a gas turbine engine, the burner comprising a radially inner pilot fuel flow passage surrounded by a radially outer main fuel flow passage. The main fuel flow passage is interposed between concentrically arranged radially inner and radially outer air flow passages. The inner and outer air flow passages are in fluid communication with one another via at least one diverting passage at an upstream end of the burner. The burner further comprises at least one control duct connectable to a reduced pressure/vacuum source for selectively reducing the air pressure in the vicinity of the diverting passage such that air flow is selectively diverted from the inner air flow passage to the outer flow passage via the diverting passage.

20 Claims, 8 Drawing Sheets

(56) References Cited

U.S. PATENT DOCUMENTS

| | | | | |
|---|---|---|---|---|
| 2010/0308135 | A1* | 12/2010 | Yamamoto | F23R 3/343<br>239/402 |
| 2012/0180490 | A1 | 7/2012 | Takami et al. | |
| 2013/0019584 | A1 | 1/2013 | Koizumi et al. | |
| 2016/0377290 | A1* | 12/2016 | Okazaki | F02C 3/145<br>60/752 |
| 2017/0313411 | A1* | 11/2017 | Seifert | F15C 1/08 |

FOREIGN PATENT DOCUMENTS

| | | |
|---|---|---|
| EP | 1391652 | 2/2004 |
| JP | 03063401 | 3/1991 |
| JP | H102558 | 1/1998 |
| JP | 2003247425 | 9/2003 |

OTHER PUBLICATIONS

Great Britain search report dated Nov. 12, 2018, issued in GB Patent Application No. 1808070.5.

* cited by examiner

BURNER

CROSS-REFERENCE TO RELATED APPLICATIONS

This application is based upon and claims the benefit of priority from United Kingdom patent application Number GB 1808070.5 filed on May 18, 2018, the entire contents of which are incorporated herein by reference.

BACKGROUND

Technical Field

The present disclosure relates to a burner for a combustion system e.g. for a lean-burn combustion system within a gas turbine engine. The present disclosure also relates to a combustion system having a burner, to a gas turbine engine having a combustion system and to a method of controlling the combustion cycle of a gas turbine engine.

Description of the Related Art

The combustion system of a gas turbine engine typically comprises a plurality of burners which mix fuel and air flows to generate (after ignition within a combustion chamber) a pilot flame and a main flame, the pilot flame facilitating continuity of ignition of the main flame.

Lean-burn combustion systems typically direct a greater proportion of air flow at the burner head compared to a rich-burn system which directs only a modest portion of the air flow at the burner head and then more at a later point (to burn up any soot generated in the combustion chamber).

Burners in known lean-burn systems each have concentric fuel flows (an inner pilot flow and an outer main flow) separated by and surrounded by concentric air flows. The air flows serve to maintain separation of the two fuel flows until the point of ignition and to define the flow fields and resulting flame shape in the combustion chamber. The outer air flow also serves to protect the walls of the combustion chamber to limit their temperature.

The fuel flow in each of the inner pilot flow and outer main flow is typically varied throughout the combustion cycle of the combustion system. For example, during pilot mode operation, more fuel is required by the combustor system and thus the fuel flow is increased whereas the fuel flow is reduced during mains mode operation. The inner pilot flow and outer main flow are each fed by their own fuel duct, the flow in each duct being controlled by one or more control valves (typically provided outside the engine casing).

The control valves (and the plurality of fuel ducts) create complexity in the gas turbine engine and increase the number of component parts which in turn increases unreliability, cost and weight of the engine.

SUMMARY

According to a first aspect there is provided a burner for a gas turbine engine, the burner comprising a radially inner pilot fuel flow passage surrounded by a radially outer main fuel flow passage, the main fuel flow passage being interposed between concentrically arranged radially inner and radially outer air flow passages, wherein the inner and outer air flow passages are in fluid communication with one another via at least one diverting passage at an upstream end of the burner, and wherein the burner further comprises at least one control duct connectable to a reduced pressure source for selectively reducing the air pressure in the vicinity of the at least one diverting passage such that air flow is selectively diverted from the inner air flow passage to the outer flow passage via the at least one diverting passage.

When the air pressure in the vicinity of the at least one diverting passage is not reduced via the control duct(s), air flows substantially equally in the inner and outer air flow passages. When the air pressure in the vicinity of the at least one diverting passage is reduced via the control duct(s), air flow is diverted to the outer air flow passage (through the at least one diverting passage) such that the air flow in the inner air flow passage is reduced (or even eliminated).

When the air flow in the inner flow passage is reduced, the pilot and main fuel flows merge relatively quickly to create a larger pilot flame which is desirable in pilot mode. Conversely, when there is no diversion of the air flow from the inner flow passage to the outer flow passage, the pilot and main fuel flows remain separated for longer by the inner air flow which is desirable in mains mode.

Accordingly, it is possible to vary the time and position that the pilot and main fuel flows meet by controlling the relative air flows in the inner and outer air flow passages. The variation in the inner and outer air flows may also change the local pressures at the outlets of the pilot and main fuel flow passages which, in turn may be useful in controlling the proportions of the pilot and main fuel flows.

This control over the time and position that the pilot and main fuel flows meet is achieved without any valves or moving parts in the hot zone unlike the known burners which require valves close to the burner heads to vary the fuel flows. This results in a reduction in the complexity and an improvement in the safety and reliability of the resulting combustion systems.

There is always an outer air flow in the outer air flow passage which provides protection of the combustion chamber walls and ensures that all of the main fuel flow is combusted before leaving the combustion chamber.

As discussed above, the air pressure in the vicinity of the at least one diverting passage can be reduced via the control duct(s) through activation of the reduced pressure source (which may be a vacuum source). When the reduced pressure/vacuum source is not activated, there is no reduction in the air pressure.

In some embodiments, the control duct(s) may additionally be connectable to an air supply (at increased pressure) (or the reduced pressure/vacuum source may be adapted to provide an air supply) such that the air pressure in the vicinity of the at least one diverting passage can be increased. This has the effect of increasing the air flow in the inner air flow passage which can act to delay the merging of the pilot and mail fuel flows even further. It can further facilitate an improvement in the system response time when switching from Pilot mode (diverted air) to Mains mode (non-diverted air).

The term "in the vicinity of the at least one diverting passage" means that the control duct(s) may reduce the air pressure in the at least one diverting passage. Additionally/alternatively, the control duct(s) may reduce the air pressure at or proximal to an interface between the inner air flow passage and the at least one diverting passage.

In some embodiments, at least one control duct extends to a circumferentially-extending annular chamber. The annular chamber is interposed between the inner and outer air flow passages at the upstream end of the burner. The annular chamber has at least one opening in the vicinity of the at least one diverting passage. For example, there may be a single opening, for example a circumferentially-extending opening. In other embodiments, there may be a plurality of openings spaced around the circumference of the annular chamber. The opening(s) may open into the at least one diverting passage or it/they may open at or proximal to the interface between the at least one diverting passage and the inner air flow passage/channel. The reduced pressure vacuum source can act to reduce the air pressure within the annular chamber via the control duct(s) and thus within the vicinity of the at least one diverting passage via the opening (s).

The plurality of openings may be equally spaced around the circumferential direction of the annular chamber. Alternatively, the spacing between the plurality of openings and/or the density of the openings may vary around the circumferential direction. This allows the air pressure reduction (or increase) effected via the control duct(s) to be varied around the circumference of the annular chamber, a greater air pressure reduction (and therefore greater diversion of inner air flow to the outer air flow passage) being possible in the areas having reduced spacing and/or greater density.

For example, there may be a first quadrant and diametrically opposed third quadrant in the annular chamber each having a first spacing between adjacent openings, the first and third quadrants between interposed by diametrically opposed second and fourth quadrants each having a second (larger) spacing between adjacent openings. In this way, the shape of fuel flows (and resulting flame) can be controlled. Where the spacing between the openings is less (in the first and third quadrants), there will be greater diversion of air flow from the inner air flow passage to the outer air flow passage thus allowing the main fuel flow to approach the pilot fuel flow in the first and third quadrants sooner than in the second and fourth quadrants where there will be a flow of air in the inner air flow passage maintaining the spacing between the pilot and main fuel flows.

In some embodiments, the annular chamber may be axially divided into a plurality of (e.g. two or three or four) circumferentially extending sections, each section extending around only a part of the circumference annular chamber. In these embodiments, there may a plurality of control ducts. Each of the circumferentially extending sections of the annular chamber may have a respective control duct connectable to a respective reduced pressure/vacuum source. In other embodiments, a group of two or more sections may share a common control duct. In this manner, the air pressure reduction (or increase) in each of the sections (or each of the groups of sections) in the vicinity of the at least one diverting passage can be controlled separately. This also allows variation in the relative air flows in the inner and outer air flow passages around the circumference of the passages allowing control of the shape of the fuel flows (and resulting flame). There may be four sections of the annular chamber. Each of the four sections may have a dedicated control duct.

In some embodiments, at least one control duct is a radially-extending duct. In some embodiments, the fuel flow passages and air flow passages are axially-extending passages. Where there is a plurality of control ducts, they may be parallel to one another where they are axially extending and then they may extending circumferentially to reach the appropriate section of the annular chamber.

The at least one diverting passage (which may be an annular passage) extends between the inner air flow passage and outer air flow passage at the upstream end of the burner. At least the main fuel flow passage (and optionally the pilot fuel flow passage) commences axially downstream of the diverting passage. The annular chamber may be axially upstream of the diverting passage.

The at least one diverting passage may extend in an oblique direction i.e. in a radially and axially downstream direction from the inner air flow passage to the outer air flow channel.

In some embodiments, there is a single, circumferentially-extending diverting passage which is axially divided into a plurality of (e.g. two or three or four) circumferentially-extending sections. In these embodiments, at least one section (sector or quadrant) of the diverting passage is bounded at an area of variation in the density of openings around the inner air flow passage (i.e. is bounded at an area or point where the density/spacing of the openings increases/decreases).

In some embodiments, the inner air flow passage comprises a swirl generator upstream of the at least one diverting passage to swirl the inner air flow towards the at least one diverting passage such that when the air pressure is reduced in the vicinity of the at least one diverting passage, the inner air flow has a tangential component channelled towards the outer air flow passage.

In some embodiments, at least one e.g. both of the inner and outer air flow channels contain a respective swirl generator downstream of the at least one diverting passage for generating swirl within the (respective) air flow passage. For example, a first downstream swirl generator in the outer air flow passage and a second downstream swirl generator may be adapted to generate opposite swirls in the inner and outer air flows respectively in order to keep the main fuel flow separate from the pilot fuel flow.

In some embodiments, the burner comprises a core air flow passage at the axial centre of the burner i.e. radially inwards of the inner fuel flow channel. In these embodiments, both the inner and outer fuel flow passages are annular passages. Accordingly the inner fuel flow passage is interposed between the core air flow passage and the inner air flow passage. The core air flow passage may contain a swirl generator for generating swirl within the core air flow in the core air flow passage.

In some embodiments, the burner comprises a single fuel supply duct feeding both of the radially inner pilot and radially outer main fuel flow channels. The fuel supply duct may be adapted to provide a greater flow to the main fuel flow channel than the pilot fuel flow channel. For example, the fuel supply duct may be adapted to provide a fixed ratio (e.g. 2:1 or 3:1 or 4:1 or even 5:1) between the fuel flow in the main fuel flow channel and the fuel flow in the pilot fuel flow channel.

In some embodiments, the burner comprises a plurality of fuel supplies supplying multiple concentric pilot and/or mains fuel flow channels. Some of these embodiments include a central pilot fuel passage with an atomisation flow pattern; some include at least one pilot flow with an air-blast flow pattern.

In a second aspect, there is provided a combustion system comprising one or more burners according to the first aspect.

In some embodiments the combustion system comprises a plurality of burners according to the first aspect. The burners may be circumferentially ranged around a combustion chamber such that the combustor system comprises an annular combustor.

In other embodiments the combustion system comprises a plurality of chambers each with a burner according to the first aspect. The combustion chambers may be circumferentially ranged around the engine core.

The combustion system may comprise a reduced pressure source e.g. a vacuum source wherein a small mass-flow of air from at least one concentric air flow passage at the burner inlet may escape to a lower-pressure destination. Examples of such lower-pressure destinations include a plenum or pipe containing air bled from an earlier compressor stage, an entry point into a lower-pressure turbine stage, a location around the combustor or an exit pipe to the ambient environment. The reduced pressure/vacuum sources may be tailored to suit the desired levels of burner air flow diversion throughout the engine operating envelope, including different altitudes, ambient temperatures, humidity levels and other environmental aspects experienced by the platform or vehicle in which the engine is installed.

The reduced pressure/vacuum source may be adapted to additionally provide an air supply (e.g. from a source on the engine or from an accumulator) or the combustion system may additionally comprise an air supply source (e.g. an auxiliary compressor). The control duct(s) of a plurality of burners e.g. of a plurality of igniter burners (or indeed all burners in the combustion system) may be connected to the reduced pressure/vacuum source (and the air supply source where present). In these embodiments, each of the burners connected to the (common) reduced pressure/vacuum source may have a restriction (e.g. a calibrated orifice) in its control duct(s) to dampen oscillations and minimise the risk of combustor rumble which may be caused by flow of air between the control ducts.

At least one control duct may be provided with a respective air control device e.g. a solenoid valve or vortex valve to isolate or modulate the flow between the control duct(s) and the reduced pressure/vacuum source.

In a third aspect, there is provided a method of controlling the combustion cycle of a combustion system in a gas turbine engine, the combustion system comprising a burner having a radially inner pilot fuel flow and a radially outer main fuel flow, the main fuel flow being interposed between concentrically arranged radially inner and radially outer air flow passages, the method comprising selectively increasing the air flow in the outer air flow passage relative to the air flow in the inner air flow passage.

When the air flow in the outer air flow passage is increased relative to the air flow in the inner air flow passage, the pilot and main fuel flows merge relatively quickly to create a larger pilot flame which is desirable in pilot mode. Conversely, when the air in the outer air flow passage is substantially equal to (or less than) the air flow in the inner air flow passage, the pilot and main fuel flows remain separated for longer by the inner air flow which is desirable in mains mode.

Accordingly, it is possible to vary the time and position that the pilot and main fuel flows meet by controlling the relative air flows in the inner and outer air flow passages. This control over the proportions of the pilot and main fuel flows and control over the time and position that the fuel flows meet is achieved without any valves or moving parts unlike the known method of controlling burners which require valves to vary the fuel flows. This results in a reduction in the complexity and an increase in the reliability of the resulting combustion systems.

There is always an outer air flow in the outer air flow passage which provides protection of the combustion chamber walls and ensures that all of the main fuel flow is combusted before leaving the combustion chamber.

The burner may be as described for the first aspect. The combustion system may be as described for the second aspect.

In some embodiments, the method comprises selectively increasing the air flow in the outer air flow passage relative to the air flow in the inner air flow passage by diverting air flow from the inner air flow passage to the outer air flow passage.

In some embodiments, the method comprises diverting air flow from the inner air flow passage to the outer air flow passage through at least one diverting passage provided in an upstream end of the burner.

In some embodiments, the method comprises diverting air flow from the inner air flow passage to the outer air flow passage through the at least one diverting passage by selectively reducing the air pressure in the vicinity of the at least one diverting passage using a reduced pressure/vacuum source.

In some embodiments, the method comprises selectively reducing the air pressure in the vicinity of the at least one diverting passage using at least one control duct (e.g. at least one radially extending control duct) connected to the reduced pressure/vacuum source.

In some embodiments, the method may further comprise selectively increasing the air flow in the inner air flow passage relative to the air flow in the outer air flow passage. This has the effect of delaying the merging of the pilot and main fuel flows, or of reducing the response time when moving from mains mode to pilot mode. For example, the method may comprise increasing the air pressure in the vicinity of the at least one diverting passage using an air supply i.e. a higher pressure air supply (e.g. via the control duct).

As discussed above, the term "in the vicinity of the at least one diverting passage" means that the method may comprise reducing the air pressure in the at least one diverting passage. Additionally/alternatively, the method may comprise reducing the air pressure at or proximal to an interface between the inner air flow passage and the at least one diverting passage.

In some embodiments, the method may comprise reducing (or increasing) the air pressure in the vicinity of the at least one diverting passage equally around the circumferential extension of the at least one diverting passage (which may be an annular diverting passage). This may be achieved using a single or a plurality of openings equally spaced around the circumferential direction of an annular chamber as described above for the first aspect.

Alternatively, the method may comprise reducing (or increasing) the air pressure in the vicinity of the at least one diverting passage by differing amounts around the circumferential extension of the at least one diverting passage. This may be achieved using a plurality of openings wherein the spacing between the plurality of openings and/or the density of the openings may vary around the circumferential direction of the annular chamber as described above for the first aspect.

This allows the air pressure reduction effected via the control duct(s) to be varied around the circumference of the annular chamber, the method resulting in a greater air pressure reduction (and therefore greater diversion of inner air flow to the outer air flow passage) being possible in the areas having reduced spacing and/or greater density.

Another method for reducing (or increasing) the air pressure in the vicinity of the at least one diverting passage by differing amounts around the circumferential extension of the at least one diverting passage may be achieved by using an annular chamber axially divided into a plurality of (e.g. two or three, four or greater than four) circumferentially extending sections, each section extending around only a part of the circumference annular chamber as described above for the first aspect.

In some embodiments, the method comprises swirling the inner air flow in the inner air flow passage upstream of the at least one diverting passage (e.g. using a swirl generator) to induce a tangential component into the air flow such that the inner air flow is channelled towards the outer air flow passage to increase the air flow in the outer air flow passage.

In some embodiments, the method comprises swirling the inner and/or outer air flows in the inner and/or air flow passages downstream of the at least one diverting passage (e.g. using a respective downstream swirl generator) for generating swirl within the (respective) air flow passage. For example, the method may comprise generating opposing swirls in the inner and outer air flows in order to keep the main fuel flow separate from the pilot fuel flow.

In some embodiments, the method comprises feeding the radially inner pilot and radially outer main fuel flow channels using a single fuel supply duct. In some embodiments, the method comprises providing a substantially constant fuel flow in the fuel supply duct.

In other embodiments, the method comprises feeding the radially inner pilot and radially outer main fuel flow channels using separate fuel supply ducts, wherein the selective increases and/or selective decreases of air pressure in the vicinity of the at least one diverting passage of the inner air flow passage, and hence the selective diversions of air flow, are tailored to complement the expected or intended variation in the pilot and main fuel flows.

In a fourth aspect, there is provided a gas turbine engine comprising a combustion system according to the second aspect.

The skilled person will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

DESCRIPTION OF THE DRAWINGS

Embodiments will now be described by way of example only, with reference to the Figures, in which.

DETAILED DESCRIPTION

Figure 1:
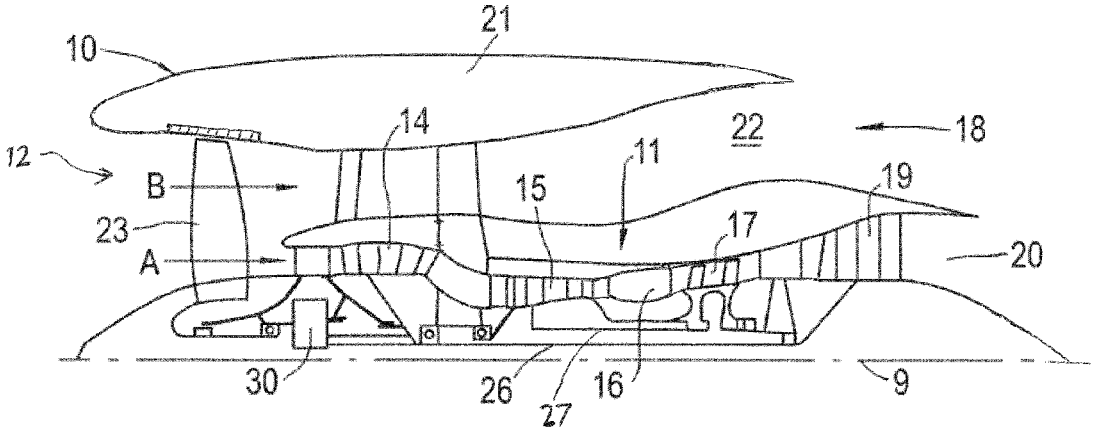
FIG. 1 is a sectional side view of a gas turbine engine.

The present disclosure concerns a burner for a gas turbine engine. Such a gas turbine engine may comprise an engine core comprising a turbine, a combustor, a compressor, and a core shaft connecting the turbine to the compressor. Such a gas turbine engine may comprise a fan (having fan blades) located upstream of the engine core.

Arrangements of the present disclosure may be particularly, although not exclusively, beneficial for fans that are driven via a gearbox. Accordingly, the gas turbine engine may comprise a gearbox that receives an input from the core shaft and outputs drive to the fan so as to drive the fan at a lower rotational speed than the core shaft. The input to the gearbox may be directly from the core shaft, or indirectly from the core shaft, for example via a spur shaft and/or gear. The core shaft may rigidly connect the turbine and the compressor, such that the turbine and compressor rotate at the same speed (with the fan rotating at a lower speed).

The gas turbine engine as described and/or claimed herein may have any suitable general architecture. For example, the gas turbine engine may have any desired number of shafts that connect turbines and compressors, for example one, two or three shafts. Purely by way of example, the turbine connected to the core shaft may be a first turbine, the compressor connected to the core shaft may be a first compressor, and the core shaft may be a first core shaft. The engine core may further comprise a second turbine, a second compressor, and a second core shaft connecting the second turbine to the second compressor. The second turbine, second compressor, and second core shaft may be arranged to rotate at a higher rotational speed than the first core shaft.

In such an arrangement, the second compressor may be positioned axially downstream of the first compressor. The second compressor may be arranged to receive (for example directly receive, for example via a generally annular duct) flow from the first compressor.

The gearbox may be arranged to be driven by the core shaft that is configured to rotate (for example in use) at the lowest rotational speed (for example the first core shaft in the example above). For example, the gearbox may be arranged to be driven only by the core shaft that is configured to rotate (for example in use) at the lowest rotational speed (for example only be the first core shaft, and not the second core shaft, in the example above). Alternatively, the gearbox may be arranged to be driven by any one or more shafts, for example the first and/or second shafts in the example above.

The gearbox may be a reduction gearbox (in that the output to the fan is a lower rotational rate than the input from the core shaft). Any type of gearbox may be used. For example, the gearbox may be a "planetary" or "star" gearbox, as described in more detail elsewhere herein. The gearbox may have any desired reduction ratio (defined as the rotational speed of the input shaft divided by the rotational speed of the output shaft), for example greater than 2.5, for example in the range of from 3 to 4.2, or 3.2 to 3.8, for example on the order of or at least 3, 3.1, 3.2, 3.3, 3.4, 3.5, 3.6, 3.7, 3.8, 3.9, 4, 4.1 or 4.2. The gear ratio may be, for example, between any two of the values in the previous sentence.

Purely by way of example, the gearbox may be a "star" gearbox having a ratio in the range of from 3.1 or 3.2 to 3.8. In some arrangements, the gear ratio may be outside these ranges.

In any gas turbine engine as described and/or claimed herein, a combustor may be provided axially downstream of the fan and compressor(s). For example, the combustor may be directly downstream of (for example at the exit of) the second compressor, where a second compressor is provided. By way of further example, the flow at the exit to the combustor may be provided to the inlet of the second turbine, where a second turbine is provided. The combustor may be provided upstream of the turbine(s).

The or each compressor (for example the first compressor and second compressor as described above) may comprise any number of stages, for example multiple stages. Each stage may comprise a row of rotor blades and a row of stator vanes, which may be variable stator vanes (in that their angle of incidence may be variable). The row of rotor blades and the row of stator vanes may be axially offset from each other.

The or each turbine (for example the first turbine and second turbine as described above) may comprise any number of stages, for example multiple stages. Each stage may comprise a row of rotor blades and a row of stator vanes. The row of rotor blades and the row of stator vanes may be axially offset from each other.

Each fan blade may be defined as having a radial span extending from a root (or hub) at a radially inner gas-washed location, or 0% span position, to a tip at a 100% span position. The ratio of the radius of the fan blade at the hub to the radius of the fan blade at the tip may be less than (or on the order of) any of: 0.4, 0.39, 0.38 0.37, 0.36, 0.35, 0.34, 0.33, 0.32, 0.31, 0.3, 0.29, 0.28, 0.27, 0.26, or 0.25. The ratio of the radius of the fan blade at the hub to the radius of the fan blade at the tip may be in an inclusive range bounded by any two of the values in the previous sentence (i.e. the values may form upper or lower bounds), for example in the range of from 0.28 to 0.32. These ratios may commonly be referred to as the hub-to-tip ratio. The radius at the hub and the radius at the tip may both be measured at the leading edge (or axially forwardmost) part of the blade. The hub-to-tip ratio refers, of course, to the gas-washed portion of the fan blade, i.e. the portion radially outside any platform.

The radius of the fan may be measured between the engine centreline and the tip of a fan blade at its leading edge. The fan diameter (which may simply be twice the radius of the fan) may be greater than (or on the order of) any of: 220 cm, 230 cm, 240 cm, 250 cm (around 100 inches), 260 cm, 270 cm (around 105 inches), 280 cm (around 110 inches), 290 cm (around 115 inches), 300 cm (around 120 inches), 310 cm, 320 cm (around 125 inches), 330 cm (around 130 inches), 340 cm (around 135 inches), 350 cm, 360 cm (around 140 inches), 370 cm (around 145 inches), 380 (around 150 inches) cm, 390 cm (around 155 inches), 400 cm, 410 cm (around 160 inches) or 420 cm (around 165 inches). The fan diameter may be in an inclusive range bounded by any two of the values in the previous sentence (i.e. the values may form upper or lower bounds), for example in the range of from 240 cm to 280 cm or 330 cm to 380 cm.

The rotational speed of the fan may vary in use. Generally, the rotational speed is lower for fans with a higher diameter. Purely by way of non-limitative example, the rotational speed of the fan at cruise conditions may be less than 2500 rpm, for example less than 2300 rpm. Purely by way of further non-limitative example, the rotational speed of the fan at cruise conditions for an engine having a fan diameter in the range of from 220 cm to 300 cm (for example 240 cm to 280 cm or 250 cm to 270 cm) may be in the range of from 1700 rpm to 2500 rpm, for example in the range of from 1800 rpm to 2300 rpm, for example in the range of from 1900 rpm to 2100 rpm. Purely by way of further non-limitative example, the rotational speed of the fan at cruise conditions for an engine having a fan diameter in the range of from 330 cm to 380 cm may be in the range of from 1200 rpm to 2000 rpm, for example in the range of from 1300 rpm to 1800 rpm, for example in the range of from 1400 rpm to 1800 rpm.

In use of the gas turbine engine, the fan (with associated fan blades) rotates about a rotational axis. This rotation results in the tip of the fan blade moving with a velocity $U_{tip}$. The work done by the fan blades 13 on the flow results in an enthalpy rise dH of the flow. A fan tip loading may be defined as $dH/U_{tip}^2$, where dH is the enthalpy rise (for example the 1-D average enthalpy rise) across the fan and $U_{tip}$ is the (translational) velocity of the fan tip, for example at the leading edge of the tip (which may be defined as fan tip radius at leading edge multiplied by angular speed). The fan tip loading at cruise conditions may be greater than (or on the order of) any of: 0.28, 0.29, 0.3, 0.31, 0.32, 0.33, 0.34, 0.35, 0.36, 0.37, 0.38, 0.39 or 0.4 (all units in this paragraph being $Jkg^{-1}K^{-1}/(ms^{-1})^2$). The fan tip loading may be in an inclusive range bounded by any two of the values in the previous sentence (i.e. the values may form upper or lower bounds)), for example in the range of from 0.28 to 0.31 or 0.29 to 0.3.

Gas turbine engines in accordance with the present disclosure may have any desired bypass ratio, where the bypass ratio is defined as the ratio of the mass flow rate of the flow through the bypass duct to the mass flow rate of the flow through the core at cruise conditions. In some arrangements the bypass ratio may be greater than (or on the order of) any of the following: 10, 10.5, 11, 11.5, 12, 12.5, 13, 13.5, 14, 14.5, 15, 15.5, 16, 16.5, or 17, 17.5, 18, 18.5, 19, 19.5 or 20. The bypass ratio may be in an inclusive range bounded by any two of the values in the previous sentence (i.e. the values may form upper or lower bounds), for example in the range of from 13 to 16, or 13 to 15, or 13 to 14. The bypass duct may be substantially annular. The bypass duct may be radially outside the core engine. The radially outer surface of the bypass duct may be defined by a nacelle and/or a fan case.

The overall pressure ratio of a gas turbine engine as described and/or claimed herein may be defined as the ratio of the stagnation pressure upstream of the fan to the stagnation pressure at the exit of the highest pressure compressor (before entry into the combustor). By way of non-limitative example, the overall pressure ratio of a gas turbine engine as described and/or claimed herein at cruise may be greater than (or on the order of) any of the following: 35, 40, 45, 50, 55, 60, 65, 70, 75. The overall pressure ratio may be in an inclusive range bounded by any two of the values in the previous sentence (i.e. the values may form upper or lower bounds), for example in the range of from 50 to 70.

Specific thrust of an engine may be defined as the net thrust of the engine divided by the total mass flow through the engine. At cruise conditions, the specific thrust of an engine described and/or claimed herein may be less than (or on the order of) any of the following: 110 $Nkg^{-1}s$, 105 $Nkg^{-1}s$, 100 $Nkg^{-1}s$, 95 $Nkg^{-1}s$, 90 $Nkg^{-1}s$, 85 $Nkg^{-1}s$ or 80 $Nkg^{-1}s$. The specific thrust may be in an inclusive range bounded by any two of the values in the previous sentence (i.e. the values may form upper or lower bounds), for example in the range of from 80 $Nkg^{-1}s$ to 100 $Nkg^{-1}s$, or 85 $Nkg^{-1}s$ to 95 $Nkg^{-1}s$. Such engines may be particularly efficient in comparison with conventional gas turbine engines.

A gas turbine engine as described and/or claimed herein may have any desired maximum thrust. Purely by way of non-limitative example, a gas turbine as described and/or claimed herein may be capable of producing a maximum thrust of at least (or on the order of) any of the following: 160 kN, 170 kN, 180 kN, 190 kN, 200 kN, 250 kN, 300 kN, 350 kN, 400 kN, 450 kN, 500 kN, or 550 kN. The maximum thrust may be in an inclusive range bounded by any two of the values in the previous sentence (i.e. the values may form upper or lower bounds). Purely by way of example, a gas turbine as described and/or claimed herein may be capable of producing a maximum thrust in the range of from 330 kN to 420 kN, for example 350 kN to 400 kN. The thrust referred to above may be the maximum net thrust at standard atmospheric conditions at sea level plus 15 degrees C. (ambient pressure 101.3 kPa, temperature 30 degrees C.), with the engine static.

In use, the temperature of the flow at the entry to the high pressure turbine may be particularly high. This temperature, which may be referred to as TET, may be measured at the exit to the combustor, for example immediately upstream of the first turbine vane, which itself may be referred to as a nozzle guide vane. At cruise, the TET may be at least (or on the order of) any of the following: 1400K, 1450K, 1500K, 1550K, 1600K or 1650K. The TET at cruise may be in an inclusive range bounded by any two of the values in the previous sentence (i.e. the values may form upper or lower bounds). The maximum TET in use of the engine may be, for example, at least (or on the order of) any of the following: 1700K, 1750K, 1800K, 1850K, 1900K, 1950K or 2000K. The maximum TET may be in an inclusive range bounded by any two of the values in the previous sentence (i.e. the values may form upper or lower bounds), for example in the range of from 1800K to 1950K. The maximum TET may occur, for example, at a high thrust condition, for example at a maximum take-off (MTO) condition.

A fan blade and/or aerofoil portion of a fan blade described herein may be manufactured from any suitable material or combination of materials. For example at least a part of the fan blade and/or aerofoil may be manufactured at least in part from a composite, for example a metal matrix composite and/or an organic matrix composite, such as carbon fibre. By way of further example at least a part of the fan blade and/or aerofoil may be manufactured at least in part from a metal, such as a titanium based metal or an aluminium based material (such as an aluminium-lithium alloy) or a steel based material. The fan blade may comprise at least two regions manufactured using different materials. For example, the fan blade may have a protective leading edge, which may be manufactured using a material that is better able to resist impact (for example from birds, ice or other material) than the rest of the blade. Such a leading edge may, for example, be manufactured using titanium or a titanium-based alloy. Thus, purely by way of example, the fan blade may have a carbon-fibre or aluminium based body (such as an aluminium lithium alloy) with a titanium leading edge.

A fan as described herein may comprise a central portion, from which the fan blades may extend, for example in a radial direction. The fan blades may be attached to the central portion in any desired manner. For example, each fan blade may comprise a fixture which may engage a corresponding slot in the hub (or disc). Purely by way of example, such a fixture may be in the form of a dovetail that may slot into and/or engage a corresponding slot in the hub/disc in order to fix the fan blade to the hub/disc. By way of further example, the fan blades may be formed integrally with a central portion. Such an arrangement may be referred to as a blisk or a bling. Any suitable method may be used to manufacture such a blisk or bling. For example, at least a part of the fan blades may be machined from a block and/or at least part of the fan blades may be attached to the hub/disc by welding, such as linear friction welding.

The gas turbine engines described and/or claimed herein may or may not be provided with a variable area nozzle (VAN). Such a variable area nozzle may allow the exit area of the bypass duct to be varied in use. The general principles of the present disclosure may apply to engines with or without a VAN.

The fan of a gas turbine as described and/or claimed herein may have any desired number of fan blades, for example 14, 16, 18, 20, 22, 24 or 262 fan blades.

As used herein, cruise conditions may mean cruise conditions of an aircraft to which the gas turbine engine is attached. Such cruise conditions may be conventionally defined as the conditions at mid-cruise, for example the conditions experienced by the aircraft and/or engine at the midpoint (in terms of time and/or distance) between top of climb and start of decent.

Purely by way of example, the forward speed at the cruise condition may be any point in the range of from Mach 0.7 to 0.9, for example 0.75 to 0.85, for example 0.76 to 0.84, for example 0.77 to 0.83, for example 0.78 to 0.82, for example 0.79 to 0.81, for example on the order of Mach 0.8, on the order of Mach 0.85 or in the range of from 0.8 to 0.85. Any single speed within these ranges may be the cruise condition. For some aircraft, the cruise conditions may be outside these ranges, for example below Mach 0.7 or above Mach 0.9.

Purely by way of example, the cruise conditions may correspond to standard atmospheric conditions at an altitude that is in the range of from 10000 m to 15000 m, for example in the range of from 10000 m to 12000 m, for example in the range of from 10400 m to 11600 m (around 38000 ft), for example in the range of from 10500 m to 11500 m, for example in the range of from 10600 m to 11400 m, for example in the range of from 10700 m (around 35000 ft) to 11300 m, for example in the range of from 10800 m to 11200 m, for example in the range of from 10900 m to 11100 m, for example on the order of 11000 m. The cruise conditions may correspond to standard atmospheric conditions at any given altitude in these ranges.

Purely by way of example, the cruise conditions may correspond to: a forward Mach number of 0.8; a pressure of 23000 Pa; and a temperature of −55° C. Purely by way of further example, the cruise conditions may correspond to: a forward Mach number of 0.85; a pressure of 24000 Pa; and a temperature of −54 degrees C. (which may be standard atmospheric conditions at 35000 ft).

As used anywhere herein, "cruise" or "cruise conditions" may mean the aerodynamic design point. Such an aerodynamic design point (or ADP) may correspond to the conditions (comprising, for example, one or more of the Mach Number, environmental conditions and thrust requirement) for which the fan is designed to operate. This may mean, for example, the conditions at which the fan (or gas turbine engine) is designed to have optimum efficiency.

In use, a gas turbine engine described and/or claimed herein may operate at the cruise conditions defined elsewhere herein. Such cruise conditions may be determined by the cruise conditions (for example the mid-cruise conditions) of an aircraft to which at least one (for example 2 or 4) gas turbine engine may be mounted in order to provide propulsive thrust.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

An example of a gas turbine engine for which the burner of the present disclosure is useful will now be further described with reference to the some of the drawings.

FIG. 1 illustrates a gas turbine engine 10 having a principal rotational axis 9. The engine 10 comprises an air intake 12 and a propulsive fan 23 that generates two airflows: a core airflow A and a bypass airflow B. The gas turbine engine 10 comprises a core 11 that receives the core airflow A. The engine core 11 comprises, in axial flow series, a low pressure compressor 14, a high-pressure compressor 15, combustion equipment 16, a high-pressure turbine 17, a low pressure turbine 19 and a core exhaust nozzle 20. A nacelle 21 surrounds the gas turbine engine 10 and defines a bypass duct 22 and a bypass exhaust nozzle 18. The bypass airflow B flows through the bypass duct 22. The fan 23 is attached to and driven by the low pressure turbine 19 via a shaft 26. The fan 23 has fan blades and is located upstream of the engine core 11.

In use, the core airflow A is accelerated and compressed by the low pressure compressor 14 and directed into the high pressure compressor 15 where further compression takes place. The compressed air exhausted from the high pressure compressor 15 is directed into the combustion system 16 where it is mixed with fuel and the mixture is combusted. The resultant hot combustion products then expand through, and thereby drive, the high pressure and low pressure turbines 17, 19 before being exhausted through the nozzle 20 to provide some propulsive thrust. The high pressure turbine 17 drives the high pressure compressor 15 by a suitable interconnecting shaft 27. The fan 23 generally provides the majority of the propulsive thrust.

Arrangements of the present disclosure may be particularly, although not exclusively, beneficial for fans 23 that are driven via a gearbox 30. Accordingly, the gas turbine engine may comprise a gearbox 30 that receives an input from the core shaft 26 and outputs drive to the fan 23 so as to drive the fan 23 at a lower rotational speed than the core shaft 26. The input to the gearbox 30 may be directly from the core shaft 26, or indirectly from the core shaft 26, for example via a spur shaft and/or gear.

Figure 2:
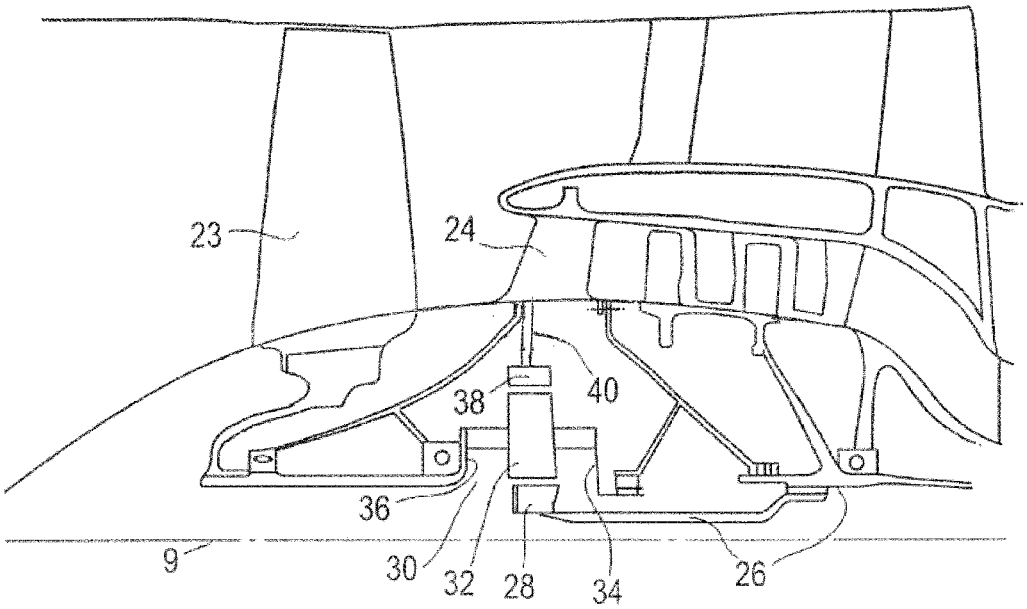
FIG. 2 is a close up sectional side view of an upstream portion of a gas turbine engine.

An exemplary arrangement for a geared fan gas turbine engine 10 is shown in FIG. 2. The low pressure turbine 19 (see FIG. 1) drives the shaft 26, which is coupled to a sun wheel, or sun gear, 28 of the epicyclic gear arrangement 30. Radially outwardly of the sun gear 28 and intermeshing therewith is a plurality of planet gears 32 that are coupled together by a planet carrier 34. The planet carrier 34 constrains the planet gears 32 to precess around the sun gear 28 in synchronicity whilst enabling each planet gear 32 to rotate about its own axis. The planet carrier 34 is coupled via linkages 36 to the fan 23 in order to drive its rotation about the engine axis 9. Radially outwardly of the planet gears 32 and intermeshing therewith is an annulus or ring gear 38 that is coupled, via linkages 40, to a stationary supporting structure 24.

Note that the terms "low pressure turbine" and "low pressure compressor" as used herein may be taken to mean the lowest pressure turbine stages and lowest pressure compressor stages (i.e. not including the fan 23) respectively and/or the turbine and compressor stages that are connected together by the interconnecting shaft 26 with the lowest rotational speed in the engine (i.e. not including the gearbox output shaft that drives the fan 23). In some literature, the "low pressure turbine" and "low pressure compressor" referred to herein may alternatively be known as the "intermediate pressure turbine" and "intermediate pressure compressor". Where such alternative nomenclature is used, the fan 23 may be referred to as a first, or lowest pressure, compression stage.

Figure 3:
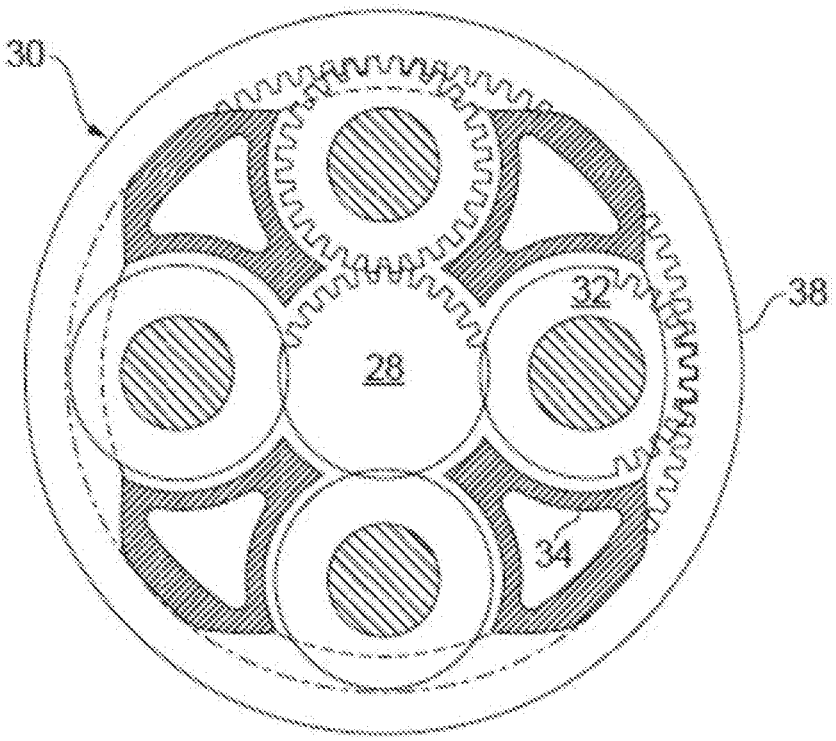
FIG. 3 is a partially cut-away view of a gearbox for a gas turbine engine.

The epicyclic gearbox 30 is shown by way of example in greater detail in FIG. 3. Each of the sun gear 28, planet gears 32 and ring gear 38 comprise teeth about their periphery to intermesh with the other gears. However, for clarity only exemplary portions of the teeth are illustrated in FIG. 3. There are four planet gears 32 illustrated, although it will be apparent to the skilled reader that more or fewer planet gears 32 may be provided within the scope of the present disclosure. Practical applications of a planetary epicyclic gearbox 30 generally comprise at least three planet gears 32.

The epicyclic gearbox 30 illustrated by way of example in FIGS. 2 and 3 is of the planetary type, in that the planet carrier 34 is coupled to an output shaft via linkages 36, with the ring gear 38 fixed. However, any other suitable type of epicyclic gearbox 30 may be used. By way of further example, the epicyclic gearbox 30 may be a star arrangement, in which the planet carrier 34 is held fixed, with the ring (or annulus) gear 38 allowed to rotate. In such an arrangement the fan 23 is driven by the ring gear 38. By way of further alternative example, the gearbox 30 may be a differential gearbox in which the ring gear 38 and the planet carrier 34 are both allowed to rotate.

It will be appreciated that the arrangement shown in FIGS. 2 and 3 is by way of example only, and various alternatives are within the scope of the present disclosure. Purely by way of example, any suitable arrangement may be used for locating the gearbox 30 in the engine 10 and/or for connecting the gearbox 30 to the engine 10. By way of further example, the connections (such as the linkages 36, 40 in the FIG. 2 example) between the gearbox 30 and other parts of the engine 10 (such as the input shaft 26, the output shaft and the fixed structure 24) may have any desired degree of stiffness or flexibility. By way of further example, any suitable arrangement of the bearings between rotating and stationary parts of the engine (for example between the input and output shafts from the gearbox and the fixed structures, such as the gearbox casing) may be used, and the disclosure is not limited to the exemplary arrangement of FIG. 2. For example, where the gearbox 30 has a star arrangement (described above), the skilled person would readily understand that the arrangement of output and support linkages and bearing locations would typically be different to that shown by way of example in FIG. 2.

Accordingly, the present disclosure extends to a gas turbine engine having any arrangement of gearbox styles (for example star or planetary), support structures, input and output shaft arrangement, and bearing locations.

Optionally, the gearbox may drive additional and/or alternative components (e.g. the intermediate pressure compressor and/or a booster compressor).

Other gas turbine engines to which the present disclosure may be applied may have alternative configurations. For example, such engines may have an alternative number of compressors and/or turbines and/or an alternative number of interconnecting shafts. By way of further example, the gas turbine engine shown in FIG. 1 has a split flow nozzle 18, 20 meaning that the flow through the bypass duct 22 has its own nozzle 18 that is separate to and radially outside the core engine nozzle 20. However, this is not limiting, and any aspect of the present disclosure may also apply to engines in which the flow through the bypass duct 22 and the flow through the core 11 are mixed, or combined, before (or upstream of) a single nozzle, which may be referred to as a mixed flow nozzle. One or both nozzles (whether mixed or split flow) may have a fixed or variable area. Whilst the described example relates to a turbofan engine, the disclosure may apply, for example, to any type of gas turbine engine, such as an open rotor (in which the fan stage is not surrounded by a nacelle) or turboprop engine, for example. In some arrangements, the gas turbine engine 10 may not comprise a gearbox 30.

The geometry of the gas turbine engine 10, and components thereof, is defined by a conventional axis system, comprising an axial direction (which is aligned with the rotational axis 9), a radial direction (in the bottom-to-top direction in FIG. 1), and a circumferential direction (perpendicular to the page in the FIG. 1 view). The axial, radial and circumferential directions are mutually perpendicular.

Turning now more specifically to the burner of the present disclosure that may be used in such a gas turbine engine.

Figure 4:
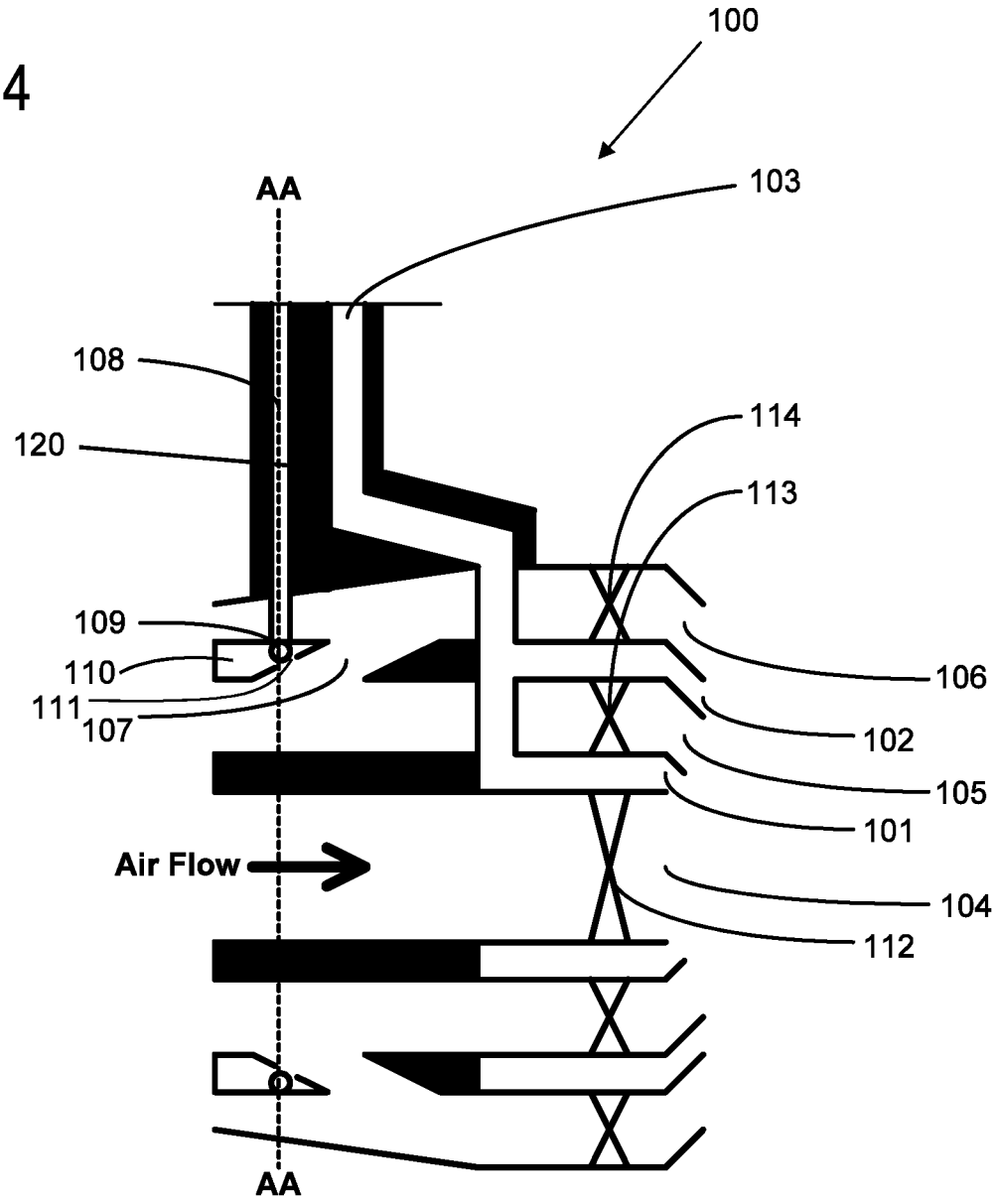
FIG. 4 shows a lateral cross section through a first embodiment of a burner.
Figure 5:
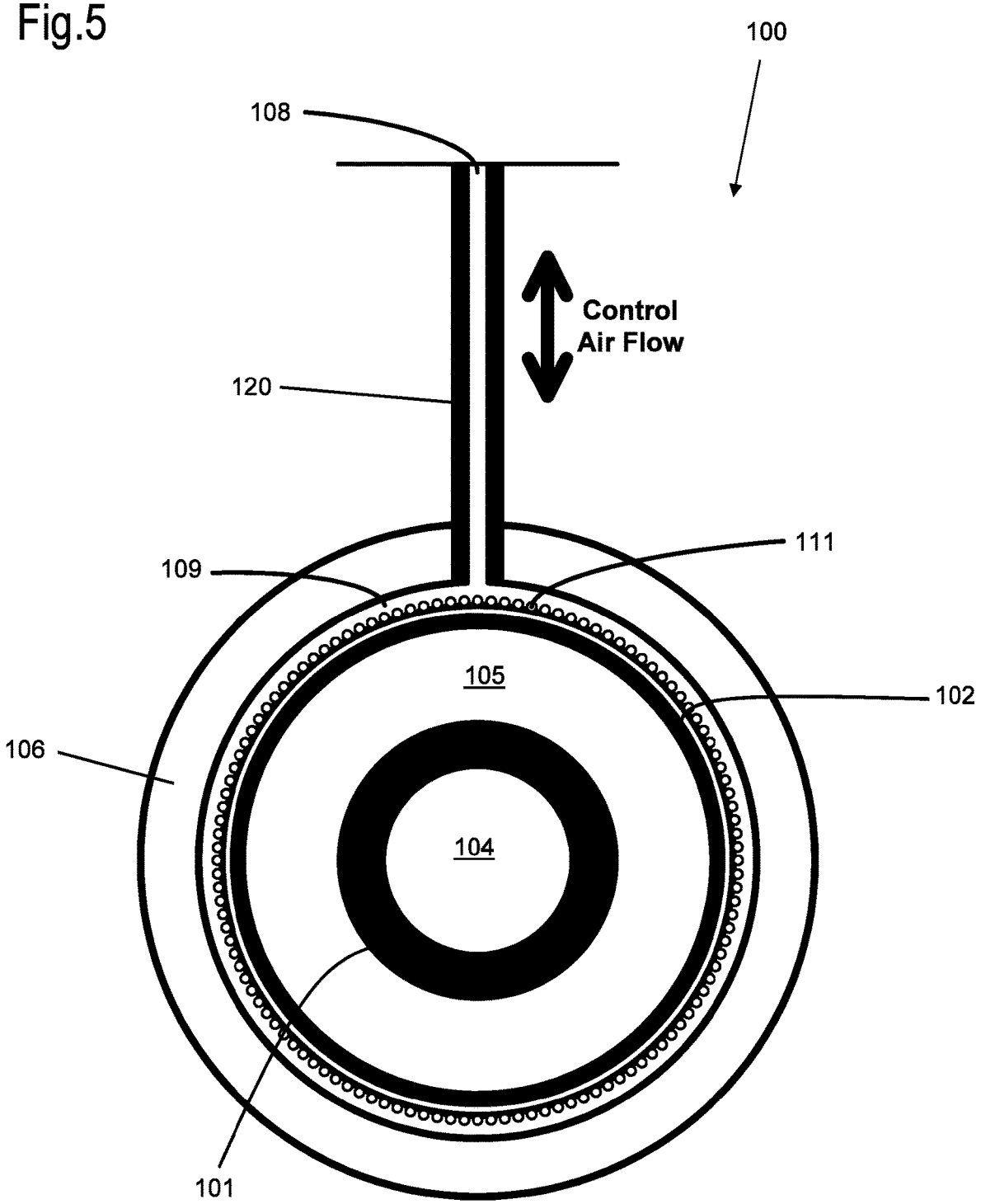
FIG. 5 shows a transverse cross-section through the line labelled AA in FIG. 4.

FIG. 4 shows a lateral cross section through a first embodiment a burner and FIG. 5 shows a transverse cross-section through the line labelled AA in FIG. 4.

The burner 100 comprises a radially inner, annular pilot fuel flow passage 101 surrounded by a radially outer, annular main fuel flow passage 102. The fuel flow passages 101, 102 are both fed with fuel by a single fuel supply duct 103.

The burner further comprises a core air flow passage 104 which is at the axial centre of the burner 100 and which is surrounded by the pilot fuel flow passage 101.

In other embodiments (not shown), there may be further fuel flow passages concentrically arranged with the pilot fuel flow passage 101 and the main fuel flow passage 102. In yet further embodiments (not shown) the pilot fuel flow passage may not be annular and may be an atomisation nozzle provided at the axial centre of the burner The main fuel flow passage 102 is interposed between a radially inner, annular air flow passage 105 and a radially outer, annular air flow passage 106.

The inner and outer air flow passages 105, 106 are in fluid communication with one another via an annular diverting passage 107 at an upstream end of the burner 100. The diverting passage 107 extends obliquely between the inner air flow passage 105 and outer air flow passage 106. The main fuel flow passage 102 and the pilot fuel flow passage 101 commence axially downstream of the diverting passage 107.

The burner 101 further comprises a radially extending control duct 108 which is connected to a reduced pressure/vacuum source (not shown) and an air supply (not shown) which may be integral with or separate from the reduced pressure/vacuum source. The vacuum is relative to the air pressure in the burner, which uses the outlet from one or more multi-stage compressors, such that the air pressure entering the burner ranges from an ambient pressure of one atmosphere, during start-up following a shutdown period, to several tens of atmospheres at maximum power, depending on engine size.

The control duct 108 and fuel supply duct 103 are bundled together in the burner stem 120. The control duct 108 and fuel supply duct 103 may be separated or thermally insulated from one another for reasons of limiting heat soakage from hot air into fuel, by any means known in the art.

The control duct 108 extends to a circumferentially-extending annular chamber 109 mounted within a manifold 110. The annular chamber 109 is interposed between the (axially-extending) inner and outer air flow passages 105, 106 at the upstream end of the burner 100. The annular chamber 109 is axially upstream of the diverting passage 107.

The annular chamber 109 has a plurality of equally spaced openings 111 (which can be seen clearly in FIG. 5) which open within the diverting passage 107 proximal to the interface between the inner air flow passage 105 and the diverting passage 107.

The core air flow passage comprises a core swirl generator 112 for inducing swirl in the core air flow and limiting the velocity of the core air flow in order to assist in maintaining the pilot flame.

The inner air flow passage 105 comprises a first downstream swirl generator 113 (downstream of the diverting passage 107) for generating swirl within the inner air flow passage 105. The outer air flow passage 106 comprises a second downstream swirl generator 114 (downstream of the diverting passage 107) for generating swirl within the outer air flow passage 106. The first and second downstream swirl generators 113, 114 may be adapted to generate opposite swirls in the inner and outer air flow passages 105, 106 respectively.

For operation in pilot mode when it is desirable to have a large pilot flame, the air pressure in the vicinity of the diverting passage 107 is reduced by activation of the reduced pressure/vacuum source such that the air pressure in the diverting passage 107 is reduced via the openings 111 in the annular chamber 109. This pressure reduction causes air flow to be diverted from the inner air flow passage 105 through the diverting passage 107 to the outer flow passage 106.

The increase in air flow in the outer air flow passage 106 (coupled with the reduction in (or even elimination of) air flow in the inner air flow passage 105) allows the main fuel flow in the main fuel flow passage 102 to merge with the pilot fuel flow in the pilot fuel flow passage 101 more quickly so that the fuel burns as a single large pilot flame.

Conversely, for operation in mains mode when it is desirable to delay merging of the main and pilot fuel flows, the reduced pressure/vacuum source is not activated so there is no reduction in air pressure in the diverting passage 107 and the air flows in the inner air flow passage 105 and outer air flow passage 106 remain substantially equal. The higher air flow in the inner air flow passage (relative to the pilot mode) maintains the separation of the main and pilot fuel flows for longer. The swirl generated by the first and second downstream swirl generators 113, 114 helps maintain the main fuel flow as an annular film separated from the pilot fuel flow.

In some embodiments, the air pressure reduction at the diverting passage 107 may be achieved by using a stored vacuum, especially during engine start-up or in low power conditions where the air pressure entering the burner is close to external ambient pressure.

In some embodiments, the air pressure at the diverting passage 107 may be increased using the air supply to increase the air flow in the inner air flow passage 105. This allows the pilot and main fuel flows to remain separated for even longer by the inner air flow.

In some embodiments, the air pressure increase and reduction may use the same air pressure accumulation equipment to store the relative-vacuum and air pressure alternately. The accumulation equipment may store the required relative pressure during another part of the engine operating cycle.

Accordingly, it is possible to vary the time and position that the pilot and main fuel flows meet by controlling the relative air flows in the inner and outer air flow passages 105, 106. This control over the proportions of the inner and outer air flows and control over the time and position that the fuel flows meet is achieved without any valve seals or moving parts unlike the known burners which require sealing valves in relative proximity to the burner stem to vary the fuel flows. Valve seal degradation effects are thus avoided.

Figure 6:
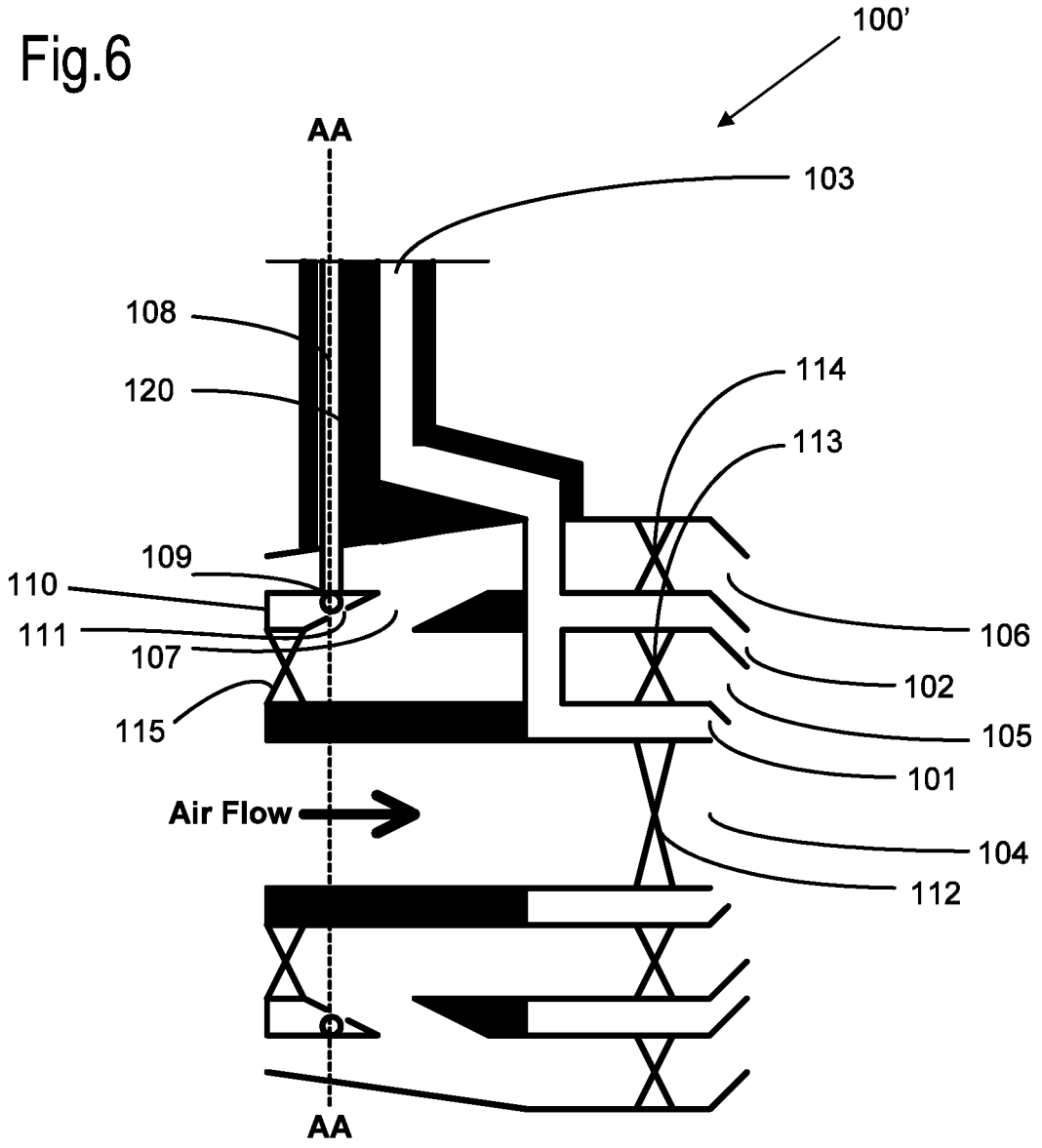
FIG. 6 shows a lateral cross section through a second embodiment of a burner.

FIG. 6 shows a further embodiment of a burner 100' where the inner air flow passage 105 comprises a swirl generator 115 upstream of the diverting passage 107 to swirl the inner air flow towards the diverting passage 107 such that the inner air flow has a tangential component channelled towards the outer air flow passage 106. This helps divert air flow from the inner air flow passage 105 to the outer air flow passage 106 via the diverting passage 107 when there is a pressure reduction at the diverting passage 107.

Figure 7:
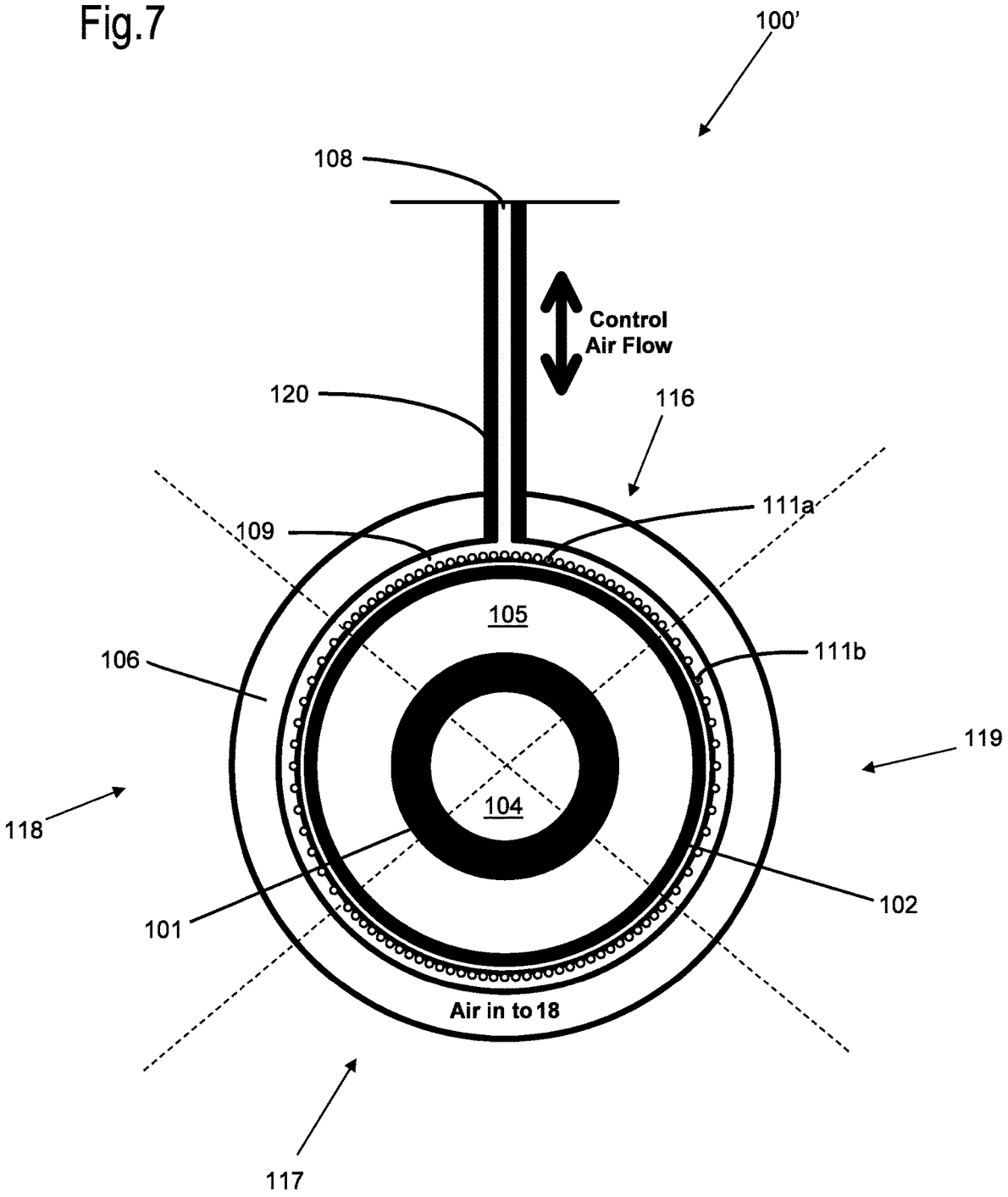
FIG. 7 shows a transverse cross-section through the line labelled AA in FIG. 6.

The FIG. 6 embodiment may have equally spaced openings 111 in the annular chamber 109 as shown in FIG. 5 or it may have unequally spaced openings 111*a* and 111*b* as shown in FIG. 7. This allows the air pressure reduction effected via the control duct 108 to be varied around the circumference of the annular chamber 109, a greater air pressure reduction (and therefore greater diversion of inner air flow to the outer air flow passage 106) being possible in the areas having reduced spacing.

As shown in FIG. 7, there is a first quadrant 116 and diametrically opposed third quadrant 117 each having a first spacing between adjacent openings 111*a*. The first and third quadrants 116, 117 are interposed by diametrically opposed second and fourth quadrants 118, 119 each having a second (larger) spacing between adjacent openings 111*b*. In this way, the shape of fuel flows (and resulting flame) can be controlled. Where the spacing between the openings 111*a* is less (in the first and third quadrants 116, 117), there will be greater diversion of air flow from the inner air flow passage 105 to the outer air flow passage 106 thus allowing the main fuel flow to approach the pilot fuel flow in the first and third quadrants 116, 117 sooner than in the second and fourth quadrants 118, 119 where there will be a flow of air in the inner air flow passage 105 maintaining the spacing between the pilot and main fuel flows. The inner and outer air flow passages 105, 106 may employ additional circumferential dividing features (not shown) to maintain or tailor the effect of the intended circumferential variations in air flow as the variation translates from the diverting passage location 107 to the burner head and thence into the flame shape.

Figure 8:
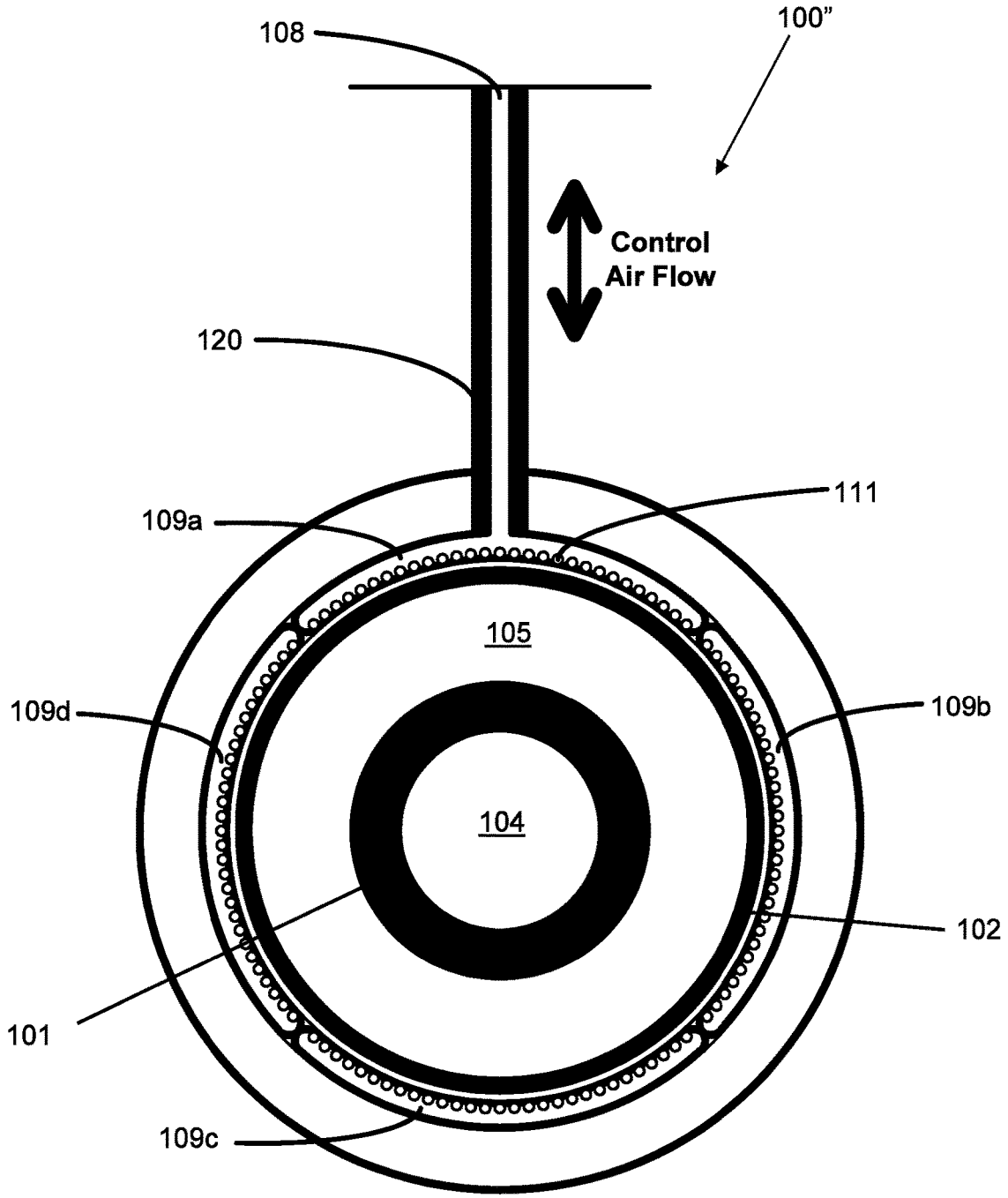
FIG. 8 shows a transverse cross-section of a further embodiment.
Figure 9:
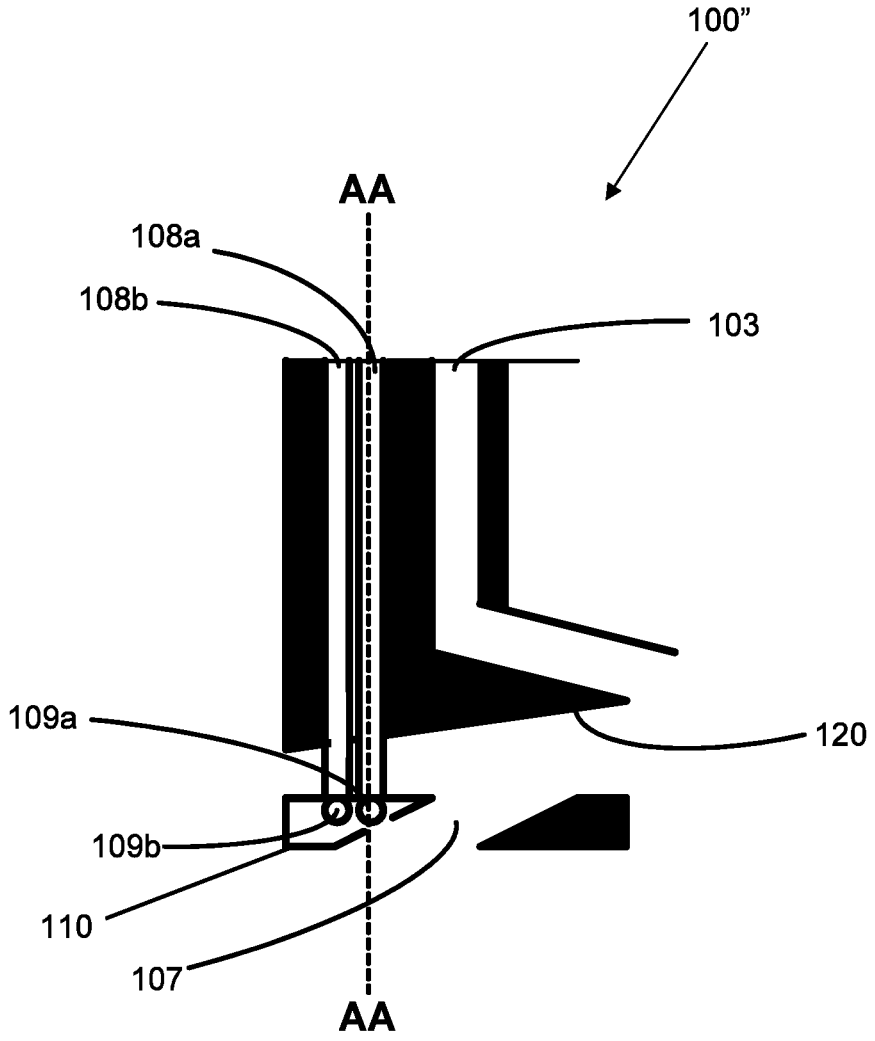
FIG. 9 shows a lateral cross section through the burner stem of the FIG. 8 embodiment.

Another way of effecting variation in the pressure reduction around the circumference of the annular chamber 109 in a burner 100" is shown in FIGS. 8 and 9.

The annular chamber 109 is axially divided into four sections 109*a*-109*d*, each section extending around only a part of the circumference annular chamber 109. As can be seen in FIG. 9, there are four control ducts 108*a*, 108*b* (only two shown for clarity). The control ducts 108*a*, 108*b* are bundled together (along with the fuel supply duct 103) in the burner stem 120 (along with any thermal insulation as required). The control ducts 108*a*, 108*b* are radially-extending but may also have a circumferentially-extending portion where they need to extend to sections 109*a*-109*d* of the annular chamber 109 which are remote from the burner stem 120.

In this manner, the air pressure reduction in each of the sections 108*a*-*d* in the vicinity of the diverting passage 109 can be controlled separately.

A plurality of burners according to any of the embodiments described above may be circumferentially arranged around a combustion chamber to provide an annular combustor which may be used in a gas turbine engine such as a gas turbine engine on an aircraft or other means of transport or in power generation or in fluid pumping applications such as oil or gas.

However, the combustion systems described above are primarily for use in a gas turbine engine such as that shown in FIG. 1 and discussed above.

It will be understood that the disclosure is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

I claim:

1. A burner for a gas turbine engine, the burner comprising a radially inner pilot fuel flow passage surrounded by a radially outer main fuel flow passage, the radially outer main fuel flow passage being interposed between concentrically arranged radially inner and radially outer air flow passages such that a main fuel flow is separate from the radially inner and radially outer air flow passages, wherein the radially inner and outer air flow passages are in fluid communication with one another via at least one diverting passage at an upstream end of the burner, and wherein the burner further comprises at least one control duct connectable to a reduced pressure/vacuum source for selectively reducing an air pressure in a vicinity of the at least one diverting passage such that air flow is selectively diverted from the radially inner air flow passage to the radially outer flow passage via the at least one diverting passage so as to allow a pilot fuel flow flowing through the inner pilot fuel flow passage and the main fuel flow to merge faster than when the air flow is not selectively diverted from the radially inner air flow passage to the radially outer flow passage.

2. The burner of claim 1, wherein the at least one control duct is additionally connectable to an increased pressure air supply.

3. The burner of claim 1, wherein the at least one control duct extends to a circumferentially-extending annular chamber, the circumferentially-extending annular chamber having at least one opening in the vicinity of the at least one diverting passage.

4. A burner for a gas turbine engine, the burner comprising a radially inner pilot fuel flow passage surrounded by a radially outer main fuel flow passage, the main fuel flow passage being interposed between concentrically arranged radially inner and radially outer air flow passages such that a main fuel flow is separate from the radially inner and radially outer air flow passages, wherein the radially inner and outer air flow passages are in fluid communication with one another via at least one diverting passage at an upstream end of the burner, wherein the burner further comprises at least one control duct connectable to a reduced pressure/vacuum source for selectively reducing an air pressure in a vicinity of the at least one diverting passage such that air flow is selectively diverted from the radially inner air flow passage to the radially outer flow passage via the at least one diverting passage so as to allow a pilot fuel flow flowing through the inner pilot fuel flow passage and the main fuel flow to merge faster than when the air flow is not selectively diverted from the radially inner air flow passage to the radially outer flow passage, wherein the at least one control duct extends to a circumferentially-extending annular chamber, the circumferentially-extending annular chamber having at least one opening in the vicinity of the at least one diverting passage, and wherein the at least one opening is at or proximal an interface between the at least one diverting passage and the radially inner air flow passage.

5. The burner of claim 3, wherein the at least one opening includes a plurality of openings.

6. The burner of claim 5, wherein the plurality of openings are equally spaced around a circumference of the circumferentially-extending annular chamber.

7. The burner of claim 5, wherein a circumferential spacing between the plurality of openings and/or a density of the plurality of openings vary around a circumferential direction.

8. The burner of claim 7, wherein the circumferentially-extending annular chamber comprises a first quadrant and diametrically opposed third quadrant each having a first spacing between adjacent openings of the plurality of openings, the first and third quadrants between interposed by diametrically opposed second and fourth quadrants each having a second, larger spacing between adjacent openings of the plurality of openings.

9. The burner of claim 5, wherein there is a single, circumferentially-extending diverting passage which is divided into a plurality of circumferentially-extending sections and wherein at least one section of the diverting passage is bounded at an area of variation in a density of the plurality of openings around the inner air flow passage.

10. The burner of claim 3, wherein the circumferentially-extending annular chamber is axially divided into a plurality of circumferentially-extending sections.

11. The burner of claim 3, wherein there is a single, circumferentially-extending diverting passage which is divided into a plurality of circumferentially-extending sections.

12. The burner of claim 1, wherein the at least one diverting passage extends in an oblique direction from the radially inner air flow passage to the radially outer air flow passage.

13. The burner of claim 1, wherein at least one of the radially inner and outer air flow channels contains a respective swirl generator downstream of the at least one diverting passage.

14. The burner of claim 1, further comprising:

a single fuel supply duct feeding both of the radially inner pilot and radially outer main fuel flow channels; and a burner stem arranged radially outward of the at least one diverting passage, wherein the single fuel supply duct and the at least one control duct are arranged within the burner stem.

15. A method of controlling a combustion cycle of a combustion system in a gas turbine engine, the combustion system comprising at least one burner having a radially inner pilot fuel flow and a radially outer main fuel flow, the radially outer main fuel flow being interposed between concentrically arranged radially inner and radially outer air flow passages such that the main fuel flow is separate from the radially inner and radially outer air flow passages, the method comprising selectively increasing air flow in the radially outer air flow passage relative to air flow in the radially inner air flow passage by diverting the air flow from the radially inner air flow passage to the radially outer air flow passage through at least one diverting passage provided in an upstream end of the at least one burner so as to allow the radially inner pilot fuel flow and the main fuel flow to merge faster than when the air flow in the radially outer air flow passage is not selectively increased, or selectively increasing the air flow in the radially inner air flow passage relative to the air flow in the radially outer air flow passage by diverting the air flow from the radially outer air flow passage to the radially inner air flow passage through the at least one diverting passage so as to allow the radially inner pilot fuel flow and the radially outer main fuel flow to remain separated longer than when the air flow is not selectively increased in the radially inner air flow passage.

16. The method of claim 15, comprising diverting the air flow from the radially inner air flow passage to the radially outer air flow passage through the at least one diverting passage by selectively reducing an air pressure in a vicinity of the at least one diverting passage using a reduced pressure/vacuum source.

17. The method of claim 16, wherein the method further comprises selectively increasing the air flow in the radially inner air flow passage relative to the air flow in the radially outer air flow passage by selectively increasing the air pressure in the vicinity of the at least one diverting passage using an increased pressure air supply.

18. The method of claim 15, wherein the method comprises reducing or increasing an air pressure in a vicinity of the at least one diverting passage equally around the circumferential extension of the at least one diverting passage, or reducing or increasing the air pressure in the vicinity of the at least one diverting passage by differing amounts around the circumferential extension of the at least one diverting passage.

19. The method of claim 15, wherein the method comprises swirling the air flow in the radially inner air flow passage upstream of the at least one diverting passage, or swirling the air flows in the radially inner and/or the radially outer air flow passages downstream of the at least one diverting passage.

20. The burner of claim 1, wherein the radially outer main fuel flow passage and the radially inner pilot fuel flow passage commence axially downstream of the at least one diverting passage.

* * * * *